United States Patent [19]

Lautenschläger et al.

[11] 3,968,540

[45] July 13, 1976

[54] FURNITURE HINGE FOR A GROOVED DOOR

[75] Inventors: Karl Lautenschläger, Reinheim, Odw.; Gerhard Lautenschläger, Wersau, Odwo, both of Germany

[73] Assignee: Karl Lautenschlager KG Mobelbeschlagfabrik, Reinheim, Odw., Germany

[22] Filed: June 20, 1975

[21] Appl. No.: 588,980

[30] Foreign Application Priority Data

Sept. 18, 1974 Germany ..... 2444569

[52] U.S. Cl. ..... 16/163; 16/164

[51] Int. Cl.[2] ..... E05D 3/06

[58] Field of Search ..... 16/163, 164, 165

[56] References Cited

UNITED STATES PATENTS

| | | | |
|---|---|---|---|
| 3,590,420 | 7/1971 | Salice | 16/164 |
| 3,605,173 | 9/1971 | Lautenschlager, Jr. | 16/163 |
| 3,724,021 | 4/1973 | Lautenschlaeger | 16/164 |
| 3,744,086 | 7/1973 | Salice | 16/164 |
| 3,863,292 | 2/1975 | Grunert et al. | 16/164 |
| 3,864,786 | 2/1975 | Salice | 16/163 |
| 3,909,879 | 10/1975 | Grunert et al. | 16/164 |

FOREIGN PATENTS OR APPLICATIONS

| | | | |
|---|---|---|---|
| 2,005,853 | 4/1969 | France | 16/164 |
| 1,128,598 | 9/1968 | United Kingdom | 16/164 |

*Primary Examiner*—Werner H. Schroeder
*Assistant Examiner*—Conrad L. Berman
*Attorney, Agent, or Firm*—Allison C. Collard

[57] ABSTRACT

A furniture hinge for a grooved door comprising a door engagement portion constituting a slip-on mount and a quadrilateral link connected to the slip-on mount including two pivot pins disposed at a door side of the mount and two control levers positioned within a lower half of the slip-on mount on the pivot pins. The slip-on mount has a jacket beneath the control levers formed with a slot extending from the mouth of the slip-on mount, the slot having a width and depth such that the control levers pass therethrough when opening the door.

2 Claims, 4 Drawing Figures

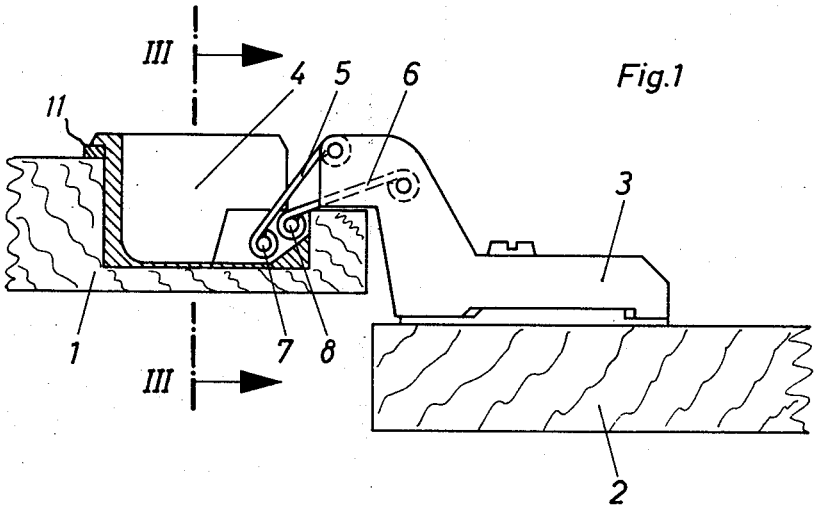
Fig.1
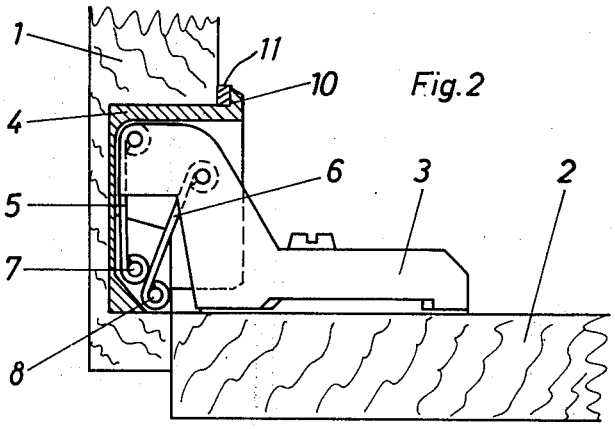
Fig.2
Fig.3
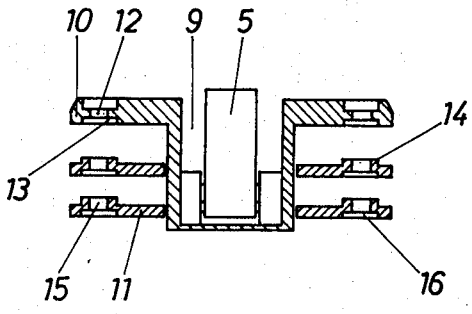
Fig.4
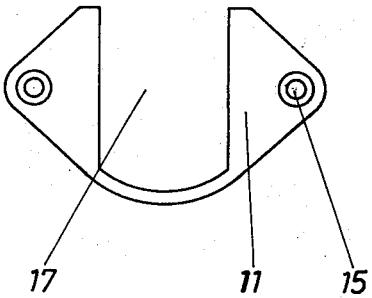

FURNITURE HINGE FOR A GROOVED DOOR

The present invention relates to a furniture hinge which is also useable for grooved doors. As a basis, we started from the state of the art, which uses the commonly known furniture hinges, whereby the links are in form of a quadrilateral and the engaging portion of the door is in the form of a slip-on mount.

The essential feature of the invention, which differs from the above-mentioned commonly known furniture hinges, consists in that the pivot pins of the control levers at the door side are located within the lower half of the slip-on mount, and that the slip-on mount jacket beneath the control levers is provided with a slot starting at the mouth of the slip on mount. This slot is so wide and deep that it permits the movement of the control level through the slot when opening the door.

Different possibilities are known for mounting the slip-on mount in the bore of the door. In the present invention, advantages are obtained by providing a retaining flange which is positioned at the distal end of the slip-on mount and which engages the inner surface of the door.

This arrangement permits a simple way of having a defined hinge type for different dimensional conditions, which result in different depths of the bore receiving the slip-on mount as will be described in more detail below. The adjustment of such different dimensions is obtained by providing a corresponding washer beneath the flange. This washer may be also of one individual type, whereby a plurality of these washers may be placed beneath the flange, if need be. For this purpose, and for preventing a displacement of the individual washers with respect to each other, each washer is provided with interengaging recesses and corresponding projections.

Other objects and features of the present invention will become apparent from the following detailed description when taken in connection with the accompanying drawing which disclose several embodiments of the invention. It is to be understood that the drawing is designed for the purposes of illustration only, and is not intended as a definition of the limits and scope of the invention disclosed.

In the drawing, wherein similar reference numerals denote similar elements throughout the several views:

FIG. 1 is a side view of a hinge in accordance with the invention, whereby the door is in an open position and showing a sectional view of the door engaging portion in accordance with a symmetric plane vertically with respect to the pivot axis;

FIG. 2 is the same view with the same sectional view as shown in FIG. 1, but with the door in a closed position;

FIG. 3 is a cross-sectional view through the slip-on mount alone, taken along the plane III—III of FIG. 1, while simultaneously showing two washers; and FIG. 4 is a plan view of a washer.

The preferred embodiment as shown and disclosed is a hinge for mounting a grooved door 1 on a carrier wall 2 of a furniture piece. The carrier wall engaging portion 3 consists of the commonly known carrier arm, so that a detailed description is not required. The door engaging portion 4, as well as the door are shown in the drawing in a sectional view in accordance with a symmetric plane vertically with respect to the pivot axis, whereby the door engaging portion is in the form of a slip-on mount and is therefore comparable with the slip-on mounts commonly used with the known hinges. This slip-on mount 4 is connected with carrier arm 3 by means of a quadrilateral link which is formed by two control levers 5 and 6.

The essential feature of the inventive concept consists in that the door side pivot pins 7 and 8 of the two control levers are positioned within the lower half of the slip-on mount. In this context, the slot 9 is very important as can be seen in FIG. 3. This slot runs beneath the two control levers from the mouth of the slip-on mount and is as wide as the two control levers 5 and 6, so that these control levers can move through the jacket of the slip-on mount 4 when opening the door. For this purpose the slot 9 must have a corresponding depth as can be seen from FIG. 1.

Normally, it suffices if the door side pivot pins of the control levers are positioned within the lower half of the slip-on mount. In special cases, the pivot pins may be moved closer to the bottom of the slip-on mount, so that they are located, for example, within the lower third of the slip-on mount.

As can be seen from FIG. 3, the slip-on mount is provided with a retaining flange 10, in known manner. The washers 11 shown in FIGS. 3 and 4 permit the adjustment to a smaller depth for the slip-on mount 4. The bores 12 in flange 10 of the slip-on mount for the retaining means are provided with framed recesses 13 at the ends facing the door. Corresponding projections 14 are positioned opposite these recesses facing the washer. The bores 15 of the washers 11 are correspondingly formed, namely, with recesses 16 at their lower side. In this way the upper washer 11 is prevented from displacement and twisting with respect to the flange 10 and in the same manner, the following washer 11, with respect to the one position thereabove.

As can be seen from FIG. 4, the washers 11 are also provided with a wide slot 17. This slot permits one to slide the washers from the side beneath flange 10 of the slip-on mount during assembly, so that the control levers can move through slot 17 when the door is opened, in the same fashion as slot 9 of the slip-on mount.

When mass producing the hinge, the depth of the slip-on mount is measured by the measure of largest possible support. When reducing the support, the size of which is selected by the thickness of the carrier wall, a correspondingly changed groove depth and reduced bore depth results. This would be necessary in doors having a low thickness which permits only a small bore depth.

The term "grooved door" designates in the field of wood-working a groove, notch or the like along one or more edges of the door. The surrounding groove in the furniture door allows the door to partially project in the boundary space which is surrounded by the boundary walls.

While only one embodiment of the present invention has been shown and described, it will be obvious to those skilled in the art that many changes and modifications may be made thereunto without departing from the spirit and scope of the invention.

What is claimed is:

1. A furniture hinge for a grooved door comprising:

a door engagement portion constituting a slip-on mount;

a quadrilateral link connected to said slip-on mount including two pivot pins disposed at a door side of said mount, and two control levers positioned within a lower half of said slip-on mount on said pivot pins;

a retaining flange formed at a lower end of said slip-on mount;

at least one washer is mounted beneath and contacting said flange; and said slip-on mount being formed with a mouth and having a jacket beneath said control levers formed with a slot extending from said mouth of said slip-on mount, said slot having a width and depth such that said control levers pass therethroughout when opening the door.

2. The furniture hinge as recited in claim 1 wherein:

said flange and at least one washer are formed with interchangable recesses and projection means at opposite faces thereof for preventing displacement of said at least one washer with respect to each other.

* * * * *